US005763358A

United States Patent [19]

Kaszczuk et al.

[11] Patent Number: 5,763,358

[45] Date of Patent: Jun. 9, 1998

[54] RELEASE AGENTS FOR DYE-DONOR ELEMENT USED IN THERMAL DYE TRANSFER

[75] Inventors: Linda A. Kaszczuk, Webster; Scott E. Tunney, Ontario; David B. Bailey, Webster; Richard W. Topel, Jr., Rochester, all of N.Y.

[73] Assignee: Eastman Kodak Company, Rochester, N.Y.

[21] Appl. No.: 792,590

[22] Filed: Jan. 31, 1997

[51] Int. Cl.[6] ..... B41M 5/035; B41M 5/38

[52] U.S. Cl. ..... 503/227; 428/195; 428/447; 428/913; 428/914

[58] Field of Search ..... 8/471; 428/195, 428/447, 913, 914; 503/227

[56] References Cited

U.S. PATENT DOCUMENTS

| | | | |
|---|---|---|---|
| 5,070,068 | 12/1991 | Nishitani | 503/227 |
| 5,430,004 | 7/1995 | Oshima et al. | 503/227 |

*Primary Examiner*—Bruce H. Hess
*Attorney, Agent, or Firm*—Harold E. Cole

[57] ABSTRACT

This invention relates to a dye-donor element for thermal dye transfer comprising a support having thereon a dye layer comprising an image dye in a polymeric binder, and wherein the dye layer also contains at least 0.005 g/m$^2$ of a siloxane block copolymer release agent.

15 Claims, No Drawings

RELEASE AGENTS FOR DYE-DONOR ELEMENT USED IN THERMAL DYE TRANSFER

FIELD OF THE INVENTION

This invention relates to the use of certain release agents in dye-donor elements for thermal dye transfer systems to alleviate dye-donor sticking during high-speed printing of high-density images.

BACKGROUND OF THE INVENTION

In recent years, thermal transfer systems have been developed to obtain prints from pictures which have been generated electronically from a color video camera. According to one way of obtaining such prints, an electronic picture is first subjected to color separation by color filters. The respective color-separated images are then converted into electrical signals. These signals are then operated on to produce cyan, magenta and yellow electrical signals. These signals are then transmitted to a thermal printer. To obtain the print, a cyan, magenta or yellow dye-donor element is placed face-to-face with a dye-receiving element. The two are then inserted between a thermal printing head and a platen roller. A line-type thermal printing head is used to apply heat from the back of the dye-donor sheet. The thermal printing head has many heating elements and is heated up sequentially in response to one of the cyan, magenta or yellow signals. The process is then repeated for the other two colors. A color hard copy is thus obtained which corresponds to the original picture viewed on a screen. Further details of this process and an apparatus for carrying it out are contained in U.S. Pat. No. 4,621,271, the disclosure of which is hereby incorporated by reference.

In thermal dye transfer printing of mono- or multi-colored images, the temperature of the thermal head is elevated to increase density of the images produced by the dyes transferred from a dye-donor element to a dye-receiver element. The faster the printing, the higher the short term temperature of a heated pixel. The elevated temperature during high speed printing causes the binder in the dye layer of the dye-donor element to soften to such an extent that it adheres to the dye-receiver element, thereby causing sticking between dye-donor and receiver elements or possibly adhering of the dye-donor layer to the dye-receiver preventing a clean separation of the two elements after printing.

DESCRIPTION OF RELATED ART

U.S. Pat. No. 5,070,068 discloses a dye-donor element which is modified by addition of either silicone-type compounds or phosphoric acid ester-type surfactants to the dye formulation. The silicone compounds used include silicone-grafted polymers, alkyl-modified silicones, fatty acid-modified silicones, phenyl group-containing silicones, and especially fluorine fatty acid-modified silicones. However, block copolymers of silicones used for this purpose are not disclosed.

U.S. Pat. No. 5,430,004 discloses a dye-donor element comprising a dye layer with binder resin, dyes, and release agent. The release agent comprises a graft copolymer containing at least one releasable segment grafted onto the main chain, selected from polysiloxane, fluorocarbon, or long-chain alkyl segments. While a block copolymer containing silicone is disclosed in comparative Example C2, column 17, it was used as the binder and not as a release agent and was found to exhibit unacceptable performance.

It is an object of this invention to provide a dye-donor element which will reduce donor-to-receiver sticking in high-speed thermal dye transfer printing of high-density images.

SUMMARY OF THE INVENTION

This and other objects are achieved in accordance with this invention which relates to a dye-donor element for thermal dye transfer comprising a support having thereon a dye layer comprising an image dye in a polymeric binder, and wherein the dye layer also containing at least 0.005 g/m$^2$ of a siloxane block copolymer release agent.

DESCRIPTION OF THE PREFERRED EMBODIMENTS

In a preferred embodiment of the invention, the siloxane block copolymer release agent is present in an amount of up to about 50% by weight of the binder.

In another preferred embodiment of the invention, the siloxane block copolymer release agent has the formula $$+A-B+$$

wherein:

A represents a siloxane moiety; and

B represents a vinyl polymer, a polyester, a polyimide, a polyurethane, polyurea, polyether or a polyamide.

In another preferred embodiment of the invention, the siloxane moiety referred to above has the formula:

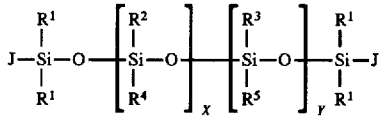

wherein:

each J independently represents a reactive end group which is removed to form a direct bond with B units forming linkages, or an aliphatic, cycloaliphatic, or aromatic organic group having a reactive end group which forms amide, urethane or ester linkages with B units;

$R^1$, $R^2$, $R^3$, $R^4$, and $R^5$ each independently represents aryl, alkyl or fluoroalkyl; and the values of x and y are each from 0 to about 400, such that the value of x+y is from 2 to about 400.

In yet another preferred embodiment, B represents a polyimide containing recurring units having the structural formula:

$$+C-D+$$

wherein C is a phenylindane radical having the structural formula:

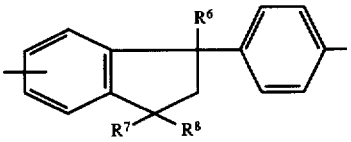

wherein $R^6$, $R^7$, and $R^8$ each independently represents H or an alkyl group; or a group having the structural formula:

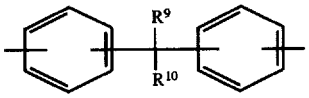

wherein $R^9$ and $R^{10}$ each independently represents H, alkyl or fluoroalkyl; or a group having the structural formula:

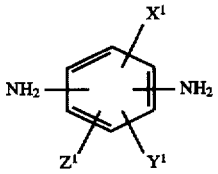

wherein $X^1$, $Y^1$, and $Z^1$ each independently represents hydrogen, halogen, alkyl or halogenated alkyl; and D has the structural formula:

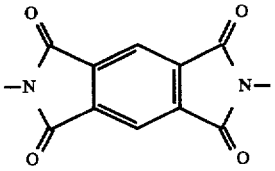

-continued or

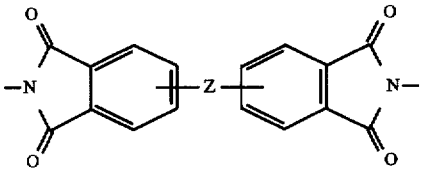

wherein Z is nil, O, CO, $SO_2$, $C(R^{11})_2$, or

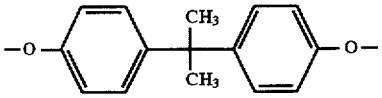

wherein $R^{11}$ each independently represents H, alkyl or fluoroalkyl.

In the above formula, B can represent a vinyl polymer, such as an acrylate, methacrylate, acrylamide, styrene, hydroxystyrene, vinylpyrrolidinone, maleic anhydride, N-substituted maleimide or alkyl ether, or any of those polymers as disclosed in U.S. patent application Ser. No. 08/633,238 of Bailey et al., filed Apr. 16, 1996, the disclosure of which is hereby incorporated by reference.

In the above formula, B can represent a polyester, such as those disclosed in U.S. Pat. No. 5,234,889; a polyurethane, polyurea or polyether such as those disclosed in U.S. Pat. No. 5,512,650; or a polyamide such as those disclosed in U.S. Pat. No. 4,604,442.

The siloxane-blocked copolymers used as release agents in the dye-donor layer according to the present invention greatly reduce donor-to-receiver sticking in high-speed thermal dye transfer printing of high-density images. The siloxane-blocked copolymers used in the present invention can be either random or alternating block copolymers.

The following polydimethylsiloxane (PDMS)-containing block copolymers are useful as release agents in accordance with the invention:

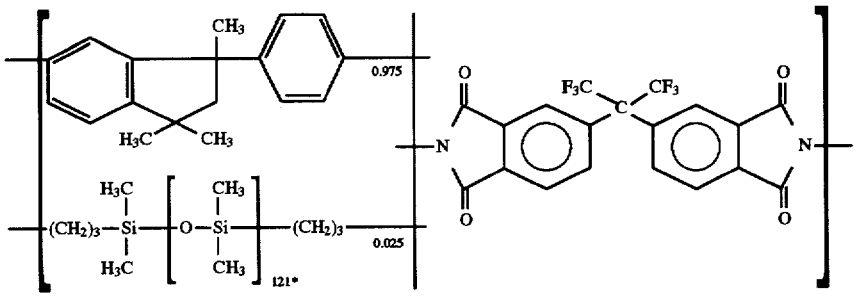

E 1 (22 wt-% PDMS)

*average degree of polymerization

-continued
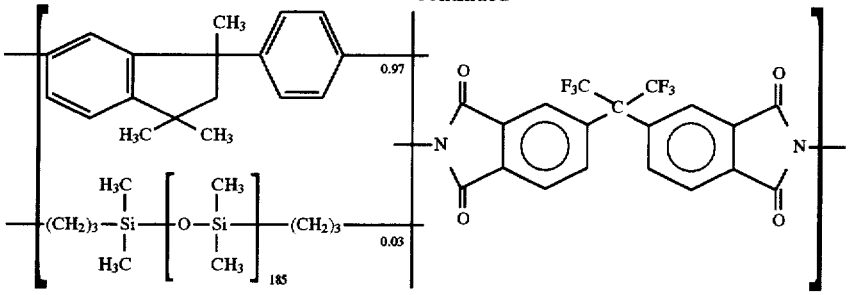
E 2 (26 wt-% PDMS)
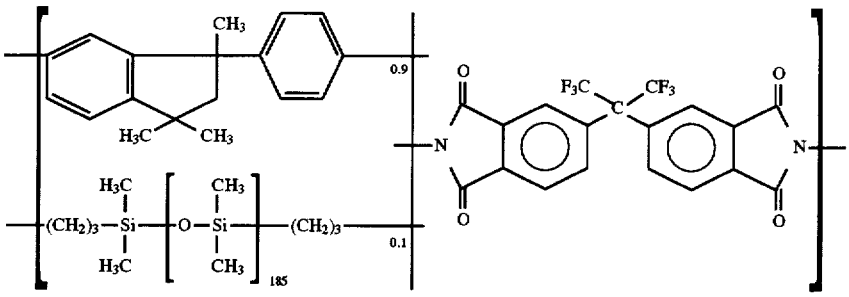
E 3 (72 wt-% PDMS)
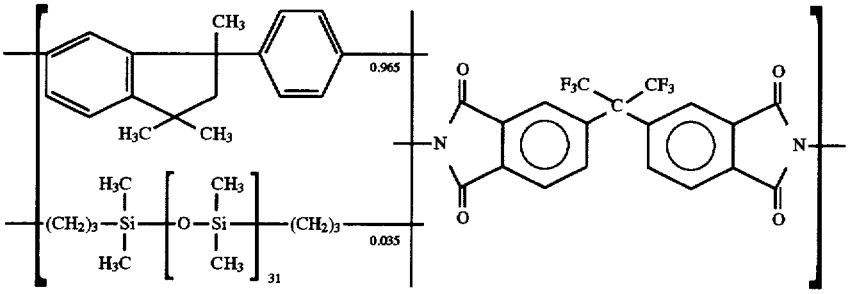
E 4 (9.2 wt-% PDMS)
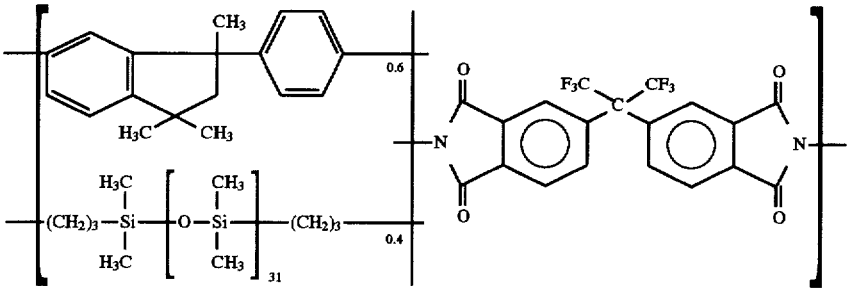
E 5 (71 wt-% PDMS)
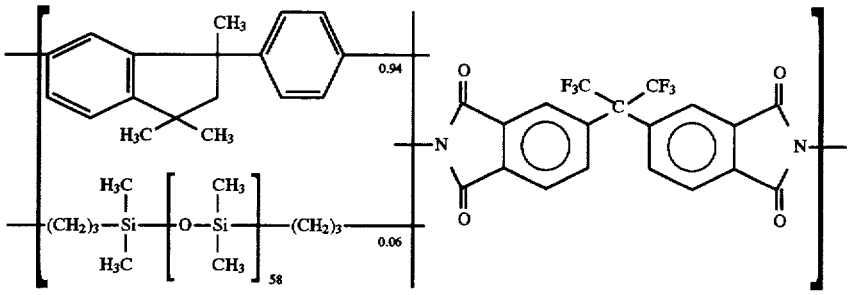

-continued
E 6 (29 wt-% PDMS)
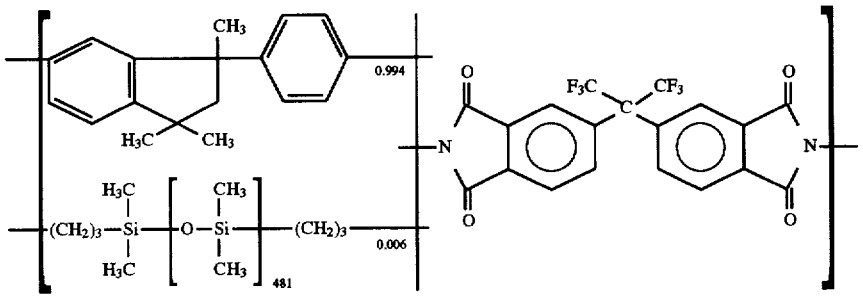
E 7 (25 wt-% PDMS)
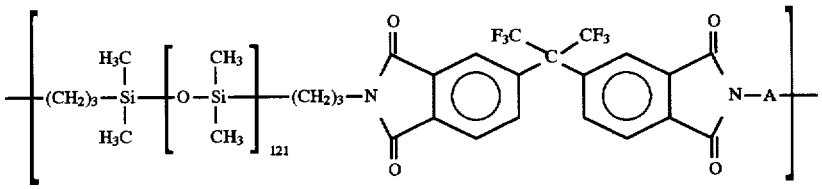
where A =
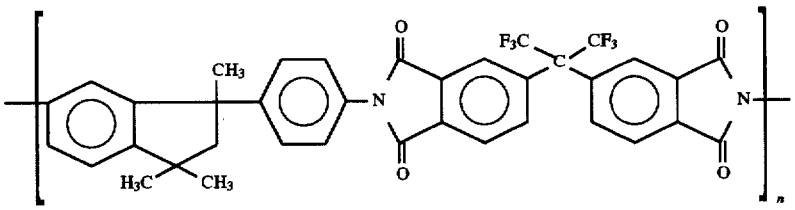
E 8 (23 wt-% PDMS)
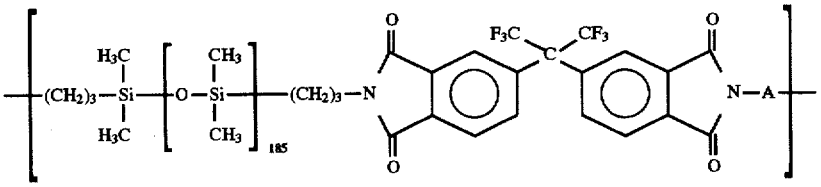
where A =
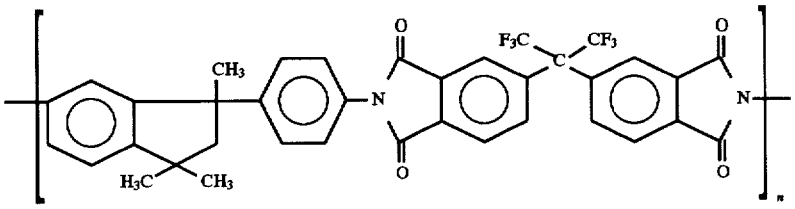
E 9 (40 wt-% PDMS)
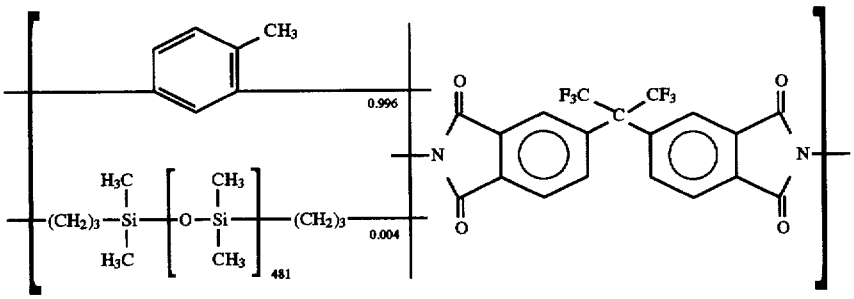
E 10 (19 wt-% PDMS)

-continued
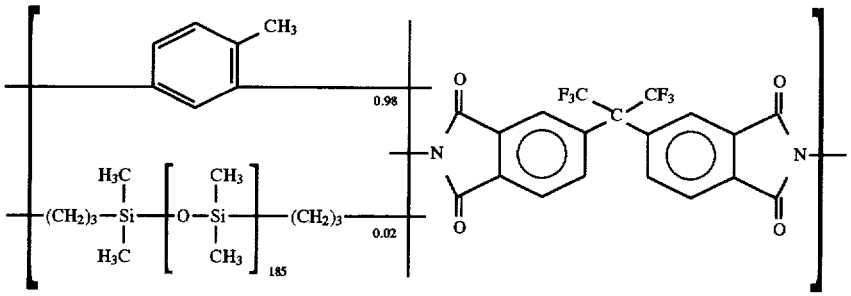
E 11 (26 wt-% PDMS)
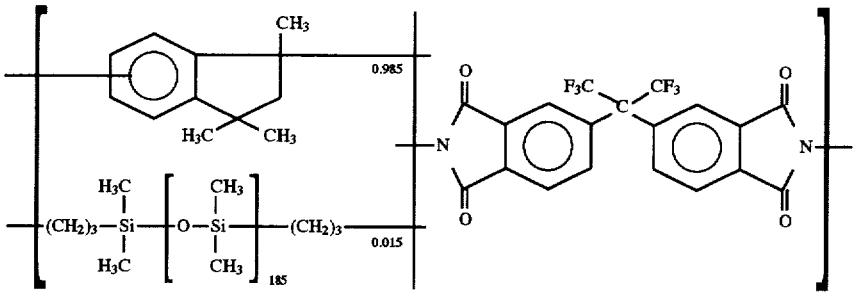
E 12 (23 wt-% PDMS)
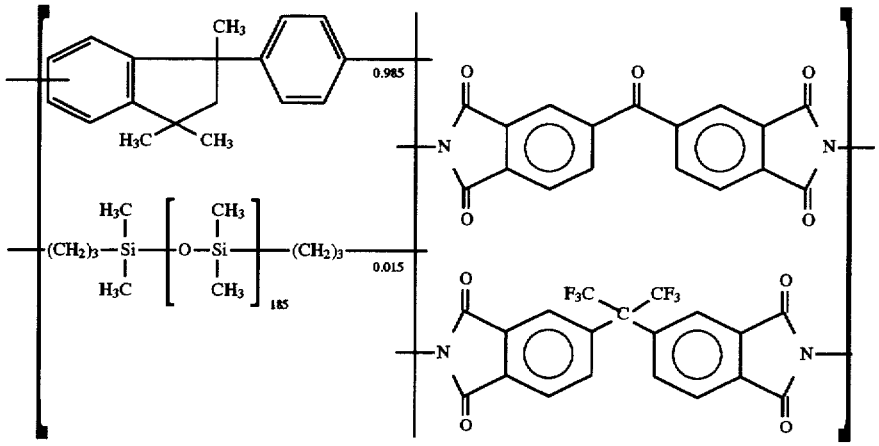
E 13 (22 wt-% PDMS)
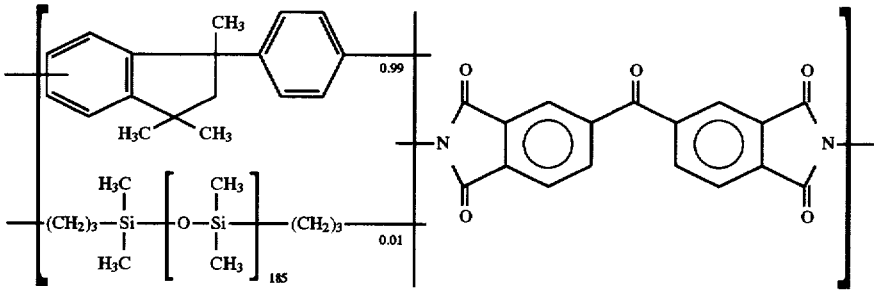
E 14 (15 wt-% PDMS)
Siltem ® STM 1300 polyimide block siloxane (General Electric)
E 15 (33 wt-% PDMS)
Siltem ® STM 1500 polyimide block siloxane (General Electric)
E 16 (28 wt-% PDMS)

-continued

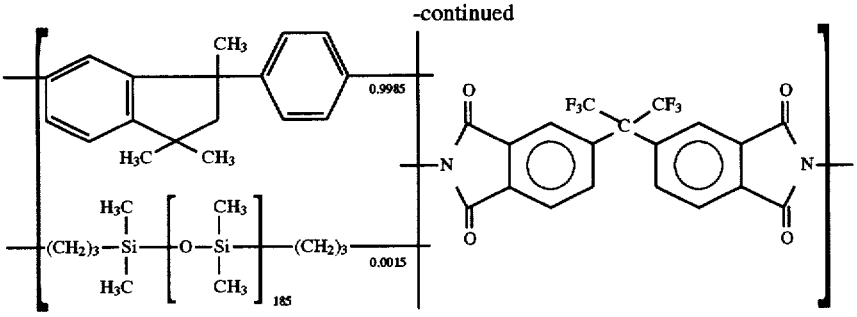

E 17 (2.5 wt-% PDMS)

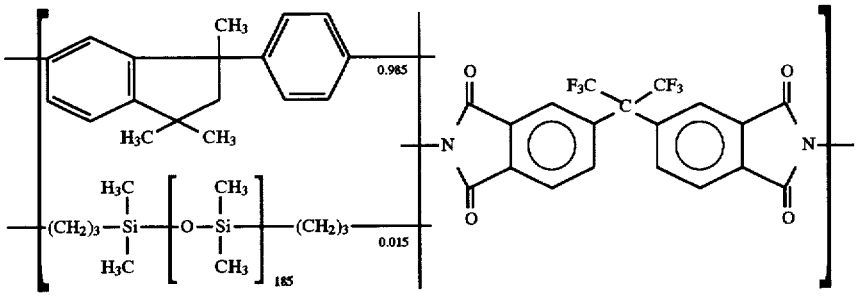

E 18 (23 wt-% PDMS)

methyl methacrylate butyl methacrylate siloxane block copolymer
(disclosed in U.S. Pat. No. 5,430,004, Example C-2, as a binder)
E 19

The following examples are vinyl siloxane block copolymers containing polydimethysiloxane (PDMS) segments which were prepared by initiating vinyl polymerization with an oligomeric siloxane initiator as described in copending U.S. patent application Ser. No. 08/633,238 of Bailey et al., filed Apr. 16, 1996.

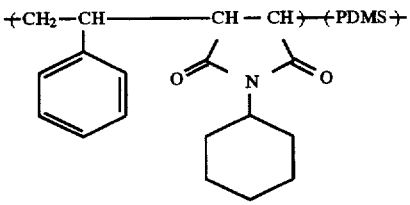

E-20

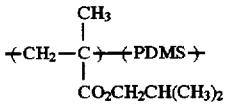

E-21

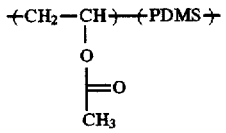

E-22

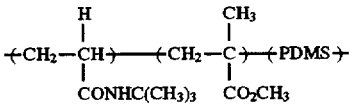

E-23

Any dye can be used in the dye-donor element of the invention provided it is transferable to the dye-receiving layer by the action of heat. Especially good results have been obtained with sublimable dyes such as anthraquinone dyes, e.g., Sumikaron Violet RS® (product of Sumitomo Chemical Co., Ltd.), Dianix Fast Violet 3R-FS® (product of Mitsubishi Chemical Industries, Ltd.), and Kayalon Polyol Brilliant Blue N-BGM® and KST Black 146® (products of Nippon Kayaku Co., Ltd.); azo dyes such as Kayalon Polyol Brilliant Blue BM®, Kayalon Polyol Dark Blue 2BM®, and KST Black KR® (products of Nippon Kayaku Co., Ltd.), Suimikaron Diazo Black 5G® (product of Sumitomo Chemical Co., Ltd.), and Miktazol Black 5GH® (product of Mitsui Toatsu Chemicals, Inc.); direct dyes such as Direct Dark Green B® (product of Mitsubishi Chemical Industries, Ltd.) and Direct Brown M® and Direct Fast Black D® (products of Nippon Kayaku Co. Ltd.); acid dyes such as Kayanol Milling Cyanine 5R® (product of Nippon Kayaku Co. Ltd.); basic dyes such as Sumiacryl Blue 6G® (product of Sumitomo Chemical Co., Ltd.), and Aizen Malachite Green® (product of Hodogaya Chemical Co., Ltd.);

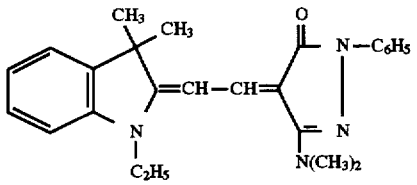

Y-1

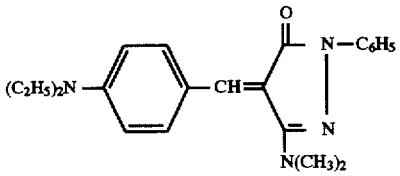

Y-2

-continued

M-1

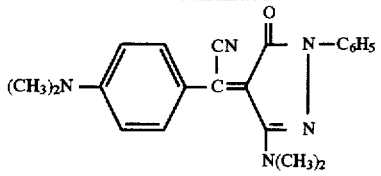

M-2

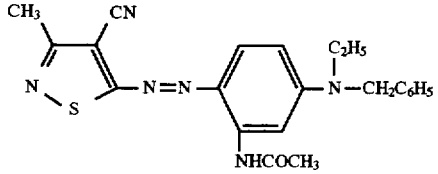

M-3

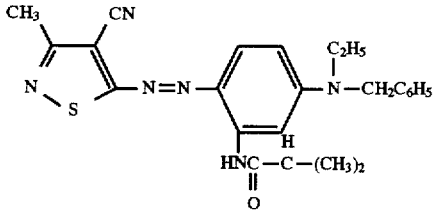

C-1

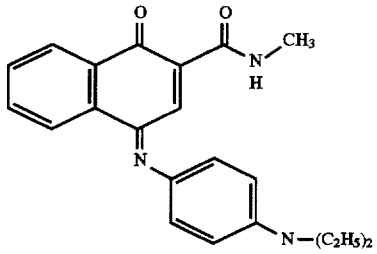

C-2

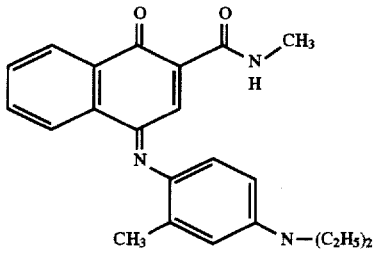

C-3

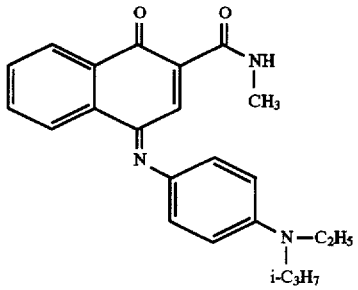

or any of the dyes disclosed in U.S. Pat. Nos. 4,541,830; 4,698,651; 4,695,287; 4,701,439; 4,757,046; 4,743,582; 4,769,360; and 4,753,922, the disclosures of which are hereby incorporated by reference. The above dyes may be employed singly or in combination. The dyes may be used at a coverage of from about 0.05 to about 1 g/m$^2$ and are preferably hydrophobic.

A dye-barrier layer may be employed in the dye-donor elements of the invention to improve the density of the transferred dye. Such dye-barrier layer materials include hydrophilic materials such as those described and claimed in U.S. Pat. No. 4,716,144.

The dye layer of the dye-donor element may be coated on the support or printed thereon by a printing technique such as a gravure process.

Any material can be used as the support for the dye-donor element of the invention provided it is dimensionally stable and can withstand the heat of the thermal head. Such materials include polyesters such as poly(ethylene terephthalate); polyamides; polycarbonates; cellulose esters such as cellulose acetate; fluorine polymers such as polyvinylidene fluoride or poly(tetrafluoroethylene-co-hexafluoropropylene); polyethers such as polyoxymethylene; polyacetals; polyolefins such as polystyrene, polyethylene, polypropylene or methylpentene polymers; and polyimides such as polyimideamides and polyetherimides. The support generally has a thickness of from about 5 to about 200 μm. It may also be coated with a subbing layer, if desired, such as those materials described in U.S. Pat. Nos. 4,695,288 or 4,737,486.

The dye in the dye-donor element of the invention is dispersed in a polymeric binder such as a cellulose derivative, e.g., cellulose acetate hydrogen phthalate, cellulose acetate, cellulose acetate propionate, cellulose acetate butyrate, cellulose triacetate or any of the materials described in U.S. Pat. No. 4,700,207; a polycarbonate, polyvinyl acetate, poly(styrene-co-acrylonitrile), a poly (sulfone) or a poly(phenylene oxide). The binder may be used at a coverage of from about 0.1 to about 5 g/m$^2$.

The reverse side of the dye-donor element may be coated with a slipping layer to prevent the printing head from sticking to the dye-donor element. Such a slipping layer would comprise either a solid or liquid lubricating material or mixtures thereof, with or without a polymeric binder or a surface-active agent. Preferred lubricating materials include oils or semicrystalline organic solids that melt below 100° C. such as poly(vinyl stearate), beeswax, perfluorinated alkyl ester polyethers, polycaprolactone, silicone oil, polytetrafluoroethylene, carbowax, poly(ethylene glycols), or any of those materials disclosed in U.S. Pat. Nos. 4,717,711; 4,717,712; 4,737,485; 4,738,950; 5,234,889; 5,252,534; and U.S. patent application Ser. No. 08/633,238 of Bailey et al., filed Apr. 16, 1996. Suitable polymeric binders for the slipping layer include poly(vinyl alcohol-co-butyral), poly(vinyl alcohol-co-acetal), polystyrene, poly(vinyl acetate), cellulose acetate butyrate, cellulose acetate propionate, cellulose acetate or ethyl cellulose.

The amount of the lubricating material to be used in the slipping layer depends largely on the type of lubricating material, but is generally in the range of about 0.001 to about 2 g/m$^2$. If a polymeric binder is employed, the lubricating material is present in the range of 0.05 to 50 weight %, preferably 0.5 to 40, of the polymeric binder employed.

The dye-receiving element that is used with the dye-donor element of the invention usually comprises a support having thereon a dye image-receiving layer. The support may be a transparent film such as a poly(ether sulfone), a polyimide, a cellulose ester such as cellulose acetate, a poly(vinyl alcohol-co-acetal) or a poly(ethylene terephthalate). The support for the dye-receiving element may also be reflective such as baryta-coated paper, polyethylene-coated paper, an ivory paper, a condenser paper or a synthetic paper such as DuPont Tyvek®. Pigmented supports such as white polyester (transparent polyester with white pigment incorporated therein), poly(vinyl chloride) and poly(vinyl chloride-co-vinyl acetate) may also be used.

The dye image-receiving layer may comprise, for example, a polycarbonate, a polyurethane, a polyester, poly (vinyl chloride), poly(vinyl chloride-co-vinyl acetate), poly (styrene-co-acrylonitrile), poly(caprolactone), a poly(vinyl acetal) such as poly(vinyl alcohol-co-butyral), poly(vinyl alcohol-co-benzal), poly(vinyl alcohol-co-acetal) or mixtures thereof. The dye image-receiving layer may be present in any amount which is effective for the intended purpose. In general, good results have been obtained at a concentration of from about 1 to about 5 g/m$^2$.

As noted above, the dye-donor elements of the invention are used to form a dye transfer image. Such a process comprises imagewise heating a dye-donor element as described above and transferring a dye image to a dye-receiving element to form the dye transfer image.

The dye-donor element of the invention may be used in sheet form or in a continuous roll or ribbon. If a continuous roll or ribbon is employed, it may have alternating areas of dyes such as sublimable cyan and/or magenta and/or yellow and/or black or other dyes. Thus, one-, two-, three- or four-color elements (or higher numbers also) are included within the scope of the invention.

In a preferred embodiment of the invention, the dye-donor element comprises a poly(ethylene terephthalate) support coated with sequential repeating areas of cyan, yellow and magenta, and the above process steps are sequentially performed for each color to obtain a three-color dye transfer image. Of course, when the process is only performed for a single color, then a monochrome dye transfer image is obtained.

Thermal printing heads which can be used to transfer dye from the dye-donor elements of the invention are available commercially. There can be employed, for example, a Fujitsu Thermal Head (FTP-040 MCSOO1), a TDK Thermal Head F415 HH7-1089 or a Rohm Thermal Head KE 2008-F3.

A thermal dye transfer assemblage of the invention comprises a) a dye-donor element as described above, and b) a dye-receiving element as described above, the dye-receiving element being in a superposed relationship with the dye-donor element so that the dye layer of the donor element is in contact with the dye image-receiving layer of the receiving element.

The above assemblage comprising these two elements may be preassembled as an integral unit when a monochrome image is to be obtained. This may be done by temporarily adhering the two elements together at their margins. After transfer, the dye-receiving element is then peeled apart to reveal the dye transfer image.

When a three-color image is to be obtained, the above assemblage is formed three times using different dye-donor elements. After the first dye is transferred, the elements are peeled apart. A second dye-donor element (or another area of the donor element with a different dye) is then brought in register with the dye-receiving element and the process repeated. The third color is obtained in the same manner.

The following examples are provided to illustrate the invention:

EXAMPLE 1

The following materials were used as comparisons or controls:

PS 513 (United Chemical Technologies)
aminopropyl dimethyl-terminated polydimethylsiloxane
C1

DC 510 silicone fluid (Dow-Corning)
C2

DC 1248 silicone fluid (Dow-Corning)
C3

Butvar ®-graft-PDMS
(Comparative example synthesized similar to Example 6, Table 4, Column 20 in U.S. Pat. No. 5,430,004)
(3.8 wt-% PDMS)
C4

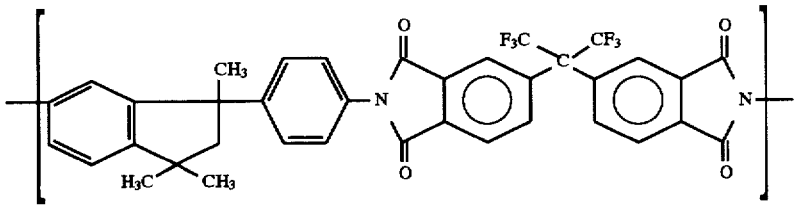

(Polyimide homopolymer of some of the polyimide siloxanes of the invention)
C5

Ultem ® polyimide (General Electric)
C6

Matrimid ® 5218 polyimide (Ciba-Geigy)
C7

Preparation of Magenta Dye-Donor Element of the Invention

A dye-donor element was prepared by gravure coating a subbing layer of 0.11 g/m$^2$ of titanium tetrabutoxide, Tyzor TBT® (DuPont Co.) in a propyl acetate/butanol (85:15) solvent mixture onto both sides of a 6 μm poly(ethylene terephthalate) support (DuPont Co.) On one side of this support was coated the following dye layer:

| | |
|---|---|
| 0.35 g/m² | CAP 482-20 (cellulose acetate propionate) 20 s viscosity (Eastman Chemical Co.) |
| 0.18 g/m² | M-1 dye |
| 0.08 g/m² | M-2 dye |
| 0.08 g/m² | M-3 dye |
| 0.02 g/m² | divinylbenzene beads (2 μm) |
| X g/m² | release agent as specified in Tables 1–3 |

On the other side of the above support was coated the following slipping layer:

| | |
|---|---|
| 0.39 g/m² | KS-1 poly(vinyl acetal) (Sekisui America Corp.) |
| 0.02 g/m² | candelilla wax |
| 0.01 g/m² | PS-513 (an aminopropyl dimethyl-terminated polydimethylsiloxane from Petrarch Systems, Inc.) |
| 0.0003 g/m² | p-toluenesulfonic acid |

Preparation of Cyan Dye-Donor Element of the Invention

A cyan dye-donor element was prepared similar to the magenta dye-donor element except that the cyan dye formulation was as follows:

| | |
|---|---|
| 0.53 g/m² | CAP 482-20 (cellulose acetate propionate) 20 s viscosity (Eastman Chemical Co.) |
| 0.13 g/m² | C-1 dye |
| 0.13 g/m² | C-2 dye |
| 0.28 g/m² | C-3 dye |
| 0.02 g/m² | divinylbenzene beads (2 μm) |
| X g/m² | release agent as specified in Tables 1–3 |

Preparation of Yellow Dye-Donor Element of the Invention

A yellow dye-donor element was prepared similar to the magenta dye-donor element except that the yellow dye formulation was as follows:

| | |
|---|---|
| 0.26 g/m² | CAP 482-20 (cellulose acetate propionate) 20 s viscosity (Eastman Chemical Co.) |
| 0.13 g/m² | Y-1 dye |
| 0.12 g/m² | Y-2 dye |
| 0.02 g/m² | divinylbenzene beads (2 μm) |
| X g/m² | release agent as specified in Tables 1–3 |

Receiver Element

The dye-receiving element employed in the experiments was a poly(vinyl chloride)/poly(vinyl acetate) receiver (0.4 mm thick, unless otherwise noted) filled with $TiO_2$ and $CaCO_3$ for whiteness.

Printing Conditions

The dye side of a dye-donor element was placed in contact with the dye-receiving layer of a dye-receiver element of the same area. A 300 dpi Kyocera Model KBE-57-12MGL2 thermal print head was pressed against the slip layer side of the assembly with a force of approximately 7 Newton pushing it against a rubber roller to create the print nip.

The imaging electronics were activated causing the assemblage to be drawn through the print nip. At the same time the resistive elements in the thermal print head were pulsed for 84 μs/pulse at 86 μs intervals during the approximately 3 millisecond/dot printing time. A step density image (measured with an X-Rite densitometer, X-Rite Corp., Grandville, Mich.) was generated incrementally increasing the number of pulses/dot from 0 to 32 (Dmin to Dmax). The voltage supplied to the print head was approximately 13 volts.

Dye donor coatings using the magenta formulation described above were prepared with X=0.02 g/m² of the release agent as defined in Table 1. The samples were printed using the conditions cited above and the results are summarized in Table 1.

Release Performance:

The ease of release for the dye side of the donor from the receiver sheet was ranked as follows:

+ easily releasable o releasable

– not releasable; dye layer sticking to the receiver

TABLE 1

Donor/Receiver Release Performance for Magenta Dye-Donors

| Release Agent | Density | Releasability |
|---|---|---|
| C4 (Control) | * | – |
| C5 (Control) | * | – |
| E1 | 1.7 | + |
| E2 | 1.8 | + |
| E3 | 1.9 | + |
| E4 | 1.8 | o |
| E5 | 1.8 | + |
| E6 | 1.8 | + |
| E7 | 1.6 | o |
| E8 | 1.8 | + |
| E9 | 1.8 | + |
| E10 | 1.6 | o |
| E11 | 1.7 | + |
| E12 | — | + |
| E13 | 1.7 | + |
| E14 | 1.7 | + |
| E15 | 1.8 | + |
| E16 | 1.8 | + |
| E20 | 1.9 | + |
| E16** | 1.8 | + |
| E21** | 1.9 | + |
| E22** | 1.8 | o |
| E23** | 1.8 | o |

*could not be measured accurately due to sticking
**receiver thickness was 0.75 mm The above data show that the block copolymer release agents of the invention have superior performance over the C-4, a Butvar®-graft-siloxane copolymer, and C-5, a polyimide homopolymer.

EXAMPLE 2

This example shows that the release agents of the invention are also independent of the dye in the dye-donor element. Samples were printed using the same printing and evaluation techniques used in Example 1 except that yellow and cyan formulations were also printed as defined above with X=0.02 g/m² of the release agents. The following results were obtained:

TABLE 2

Donor/Receiver Release Performance for Magenta, Cyan, and Yellow Dye-Donors

| Release Agent | Color | Density | Releasability |
|---|---|---|---|
| C1 (Control) | Y | * | – |
| C2 (Control) | Y | * | – |
| C3 (Control) | Y | * | – |
| C6 (Control) | Y | * | – |
| C6 (Control) | M | * | – |
| C6 (Control) | C | * | – |
| C7 (Control) | Y | * | – |
| C7 (Control) | M | * | – |
| C7 (Control) | C | * | – |
| E12 | Y | — | + |
| E15 | Y | 1.8 | + |
| E15 | M | 1.8 | + |
| E15 | C | 1.4 | o |
| E16 | Y | 1.9 | + |
| E16 | M | 1.8 | + |
| E16 | C | 1.4 | o |

*could not be measured accurately due to sticking

The above data show that the useful release agents of the invention perform independently of the dye in the dye-donor element, when compared to several control release agents.

EXAMPLE 3

The purpose of this example is to demonstrate the impact of release agent concentration on performance. Example 1 was repeated using a variety of release agent coverages as shown in Table 3. The following results were obtained:

TABLE 3

| Release Agent ($g/m^2$) | Color | Releasability |
|---|---|---|
| C1 (Control) (0.01) | Y | – |
| C2 (Control) (0.02) | Y | – |
| C3 (Control) (0.04) | Y | – |
| E18 (0.01) | Y | + |
| E18 (0.02) | Y | + |
| E18 (0.03) | Y | + |
| E18 (0.01) | M | + |
| E18 (0.02) | M | + |
| E18 (0.03) | M | + |
| E18 (0.01) | C | o |
| E18 (0.02) | C | o |
| E18 (0.03) | C | o |
| E18 (0.04) | Y | + |
| E18 (0.09) | Y | + |
| E18 (0.11) | Y | + |

The above data show that the release agents of the invention work well at a variety of concentrations of the release copolymer in the layer, when compared to several control release agents.

EXAMPLE 4

In an experiment similar to Example 2, the block copolymer (E-19), disclosed in comparative example C2 in U.S. Pat. No. 5,430,004 and used as a binder, was prepared and coated in yellow, magenta and cyan formulations and compared against E16 in a similar format with X=0.02 $g/m^2$ of release agent, except as noted. Both CAP 482-20 (Eastman Chem. Co.) and KS-1 (Sekisui Chem. Co.) were used as binders. The receiver thickness was 0.75 mm. The following results were obtained:

TABLE 4

| Release Agent | Dye-Donor Binder | Color | Density | Releasability |
|---|---|---|---|---|
| E16 | CAP482-20 | Y | 2.0 | + |
| E16 | CAP482-20 | M | 1.9 | + |
| E16 | CAP482-20 | C | 1.5 | + |
| E16 | KS-1 | Y | 2.0 | + |
| E16 | KS-1 | M | 1.8 | + |
| E19 | CAP482-20 | Y | 1.9 | o |
| E19 | *KS-1 (0.016 $g/m^2$) | Y | 2.0 | + |
| E19 | *KS-1 (0.016 $g/m^2$) | M | 1.8 | + |
| E19 | *KS-1 (0.016 $g/m^2$) | C | 1.5 | + |

*used 15/1 binder/release agent ratio as in Table 5 U.S. Pat. No. 5,430,004

The above results show that siloxane-block copolymers, when used as an additive and not as the binder as disclosed in U.S. Pat. No. 5,430,004, do work well for releasability.

The invention has been described in detail with particular reference to preferred embodiments thereof, but it will be understood that variations and modifications can be effected within the spirit and scope of the invention.

What is claimed is:

1. A dye-donor element for thermal dye transfer comprising a support having thereon a dye layer comprising an image dye in a polymeric binder, said dye layer also containing at least 0.005 $g/m^2$ of a siloxane block copolymer release agent.

2. The element of claim 1 wherein said siloxane block copolymer release agent is present in an amount of up to about 50% by weight of said binder.

3. The element of claim 1 wherein said siloxane block copolymer release agent has the formula $$+A-B+$$

wherein:

A represents a siloxane moiety; and

B represents a vinyl polymer, a polyester, a polyimide, a polyurethane, polyurea, polyether or a polyamide.

4. The element of claim 3 wherein said siloxane moiety has the formula:

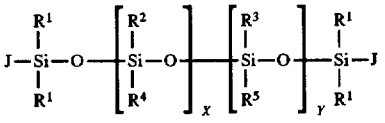

wherein:

each J independently represents a reactive end group which is removed to form a direct bond with B units forming linkages, or an aliphatic, cycloaliphatic, or aromatic organic group having a reactive end group which forms amide, urethane or ester linkages with B units;

$R^1$, $R^2$, $R^3$, $R^4$, and $R^5$ each independently represents aryl, alkyl or fluoroalkyl; and the values of x and y are each from 0 to about 400, such that the value of x+y is from 2 to about 400.

5. The element of claim 3 wherein said B represents a polyimide containing recurring units having the structural formula:

+C—D+ wherein C is a phenylindane radical having the structural formula:

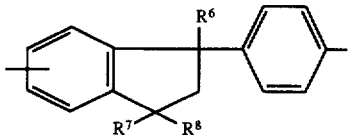

wherein $R^6$, $R^7$, and $R^8$ each independently represents H or an alkyl group; or a group having the structural formula:

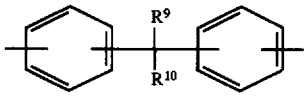

wherein $R^9$ and $R^{10}$ each independently represents H, alkyl or fluoroalkyl; or a group having the structural formula:

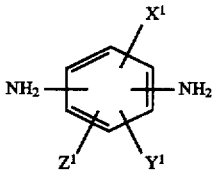

wherein $X^1$, $Y^1$, and $Z^1$ each independently represents hydrogen, halogen, alkyl or halogenated alkyl; and D has the structural formula:

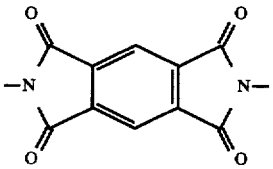

or

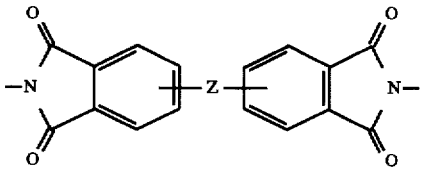

wherein Z is nil, O, CO, $SO_2$, $C(R^{11})_2$, or

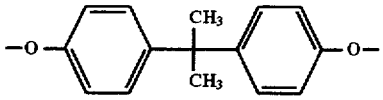

wherein $R^{11}$ each independently represents H, alkyl or fluoroalkyl.

6. A process of forming a dye transfer image comprising:

a) imagewise-heating a dye-donor element comprising a support having thereon a dye layer comprising a dye dispersed in a binder, and b) transferring a dye image to a dye-receiving element to form said dye transfer image, wherein said dye layer also contains at least 0.005 g/m$^2$ of a siloxane block copolymer release agent.

7. The process of claim 6 wherein said siloxane block copolymer release agent is present in an amount of up to about 50% by weight of said binder.

8. The process of claim 6 wherein said siloxane block copolymer release agent has the formula

+A—B+ wherein:

A represents a siloxane moiety; and

B represents a vinyl polymer, a polyester, a polyimide, a polyurethane, polyurea, polyether or a polyamide.

9. The process of claim 8 wherein said siloxane moiety has the formula:

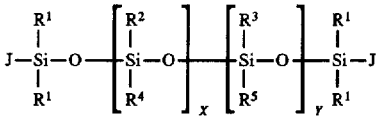

wherein:

each J independently represents a reactive end group which is removed to form a direct bond with B units forming linkages, or an aliphatic, cycloaliphatic, or aromatic organic group having a reactive end group which forms amide, urethane or ester linkages with B units;

$R^1$, $R^2$, $R^3$, $R^4$, and $R^5$ each independently represents aryl, alkyl or fluoroalkyl; and the values of x and y are each from 0 to about 400, such that the value of x+y is from 2 to about 400.

10. The process of claim 8 wherein said B represents a polyimide contains recurring units having the structural formula:

+C—D+ wherein C is a phenylindane radical having the structural formula:

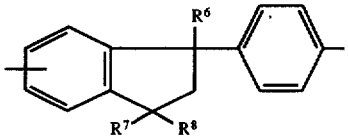

wherein $R^6$, $R^7$, and $R^8$ each independently represents H or an alkyl group; or a group having the structural formula:

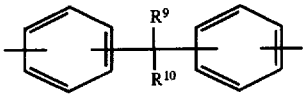

wherein $R^9$ and $R^{10}$ each independently represents H, alkyl or fluoroalkyl; or a group having the structural formula:

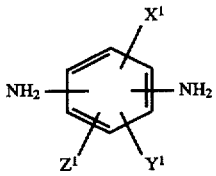

wherein $X^1$, $Y^1$, and $Z^1$ each independently represents hydrogen, halogen, alkyl or halogenated alkyl; and D has the structural formula:

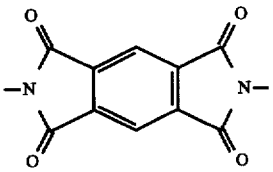

or

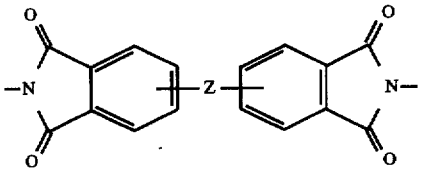

wherein Z is nil, O, CO, $SO_2$, $C(R^{11})_2$, or

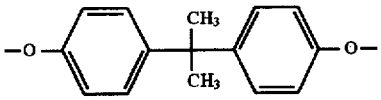

wherein $R^{11}$ each independently represents H, alkyl or fluoroalkyl.

11. A thermal dye transfer assemblage comprising:

a) a dye-donor element comprising a support having thereon a dye layer comprising an image dye dispersed in a polymeric binder, and b) a dye-receiving element comprising a support having thereon a dye image-receiving layer, said dye-receiving element being in superposed relationship with said dye-donor element so that said dye layer is in contact with said dye image-receiving layer, wherein said dye layer also contains at least 0.005 g/$m^2$ of a siloxane block copolymer release agent.

12. The assemblage of claim 11 wherein said siloxane block copolymer release agent is present in an amount of up to about 50% by weight of said binder.

13. The assemblage of claim 11 wherein said siloxane block copolymer release agent has the formula

+A—B+ wherein:

A represents a siloxane moiety; and

B represents a vinyl polymer, a polyester, a polyimide, a polyurethane, polyurea, polyether or a polyamide.

14. The assemblage of claim 13 wherein said siloxane moiety has the formula:

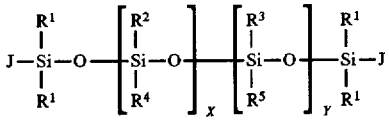

wherein:

each J independently represents a reactive end group which is removed to form a direct bond with B units forming linkages, or an aliphatic, cycloaliphatic, or aromatic organic group having a reactive end group which forms amide, urethane or ester linkages with B units;

$R^1$, $R^2$, $R^3$, $R^4$, and $R^5$ each independently represents aryl, alkyl or fluoroalkyl; and the values of x and y are each from 0 to about 400, such that the value of x+y is from 2 to about 400.

15. The assemblage of claim 13 wherein said B represents a polyimide contains recurring units having the structural formula:

+C—D+ wherein C is a phenylindane radical having the structural formula:

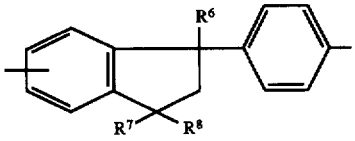

wherein $R^6$, $R^7$, and $R^8$ each independently represents H or an alkyl group; or a group having the structural formula:

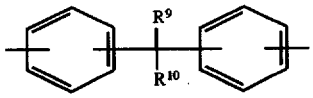

wherein $R^9$ and $R^{10}$ each independently represents H, alkyl or fluoroalkyl; or a group having the structural formula:

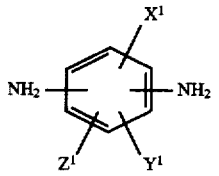
wherein $X^1$, $Y^1$, and $Z^1$ each independently represents hydrogen, halogen, alkyl or halogenated alkyl; and D has the structural formula:
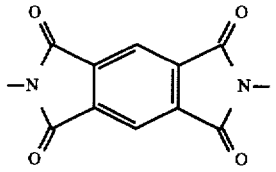
or
-continued
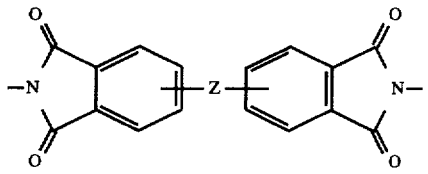
wherein Z is nil, O, CO, $SO_2$, $C(R^{11})_2$, or
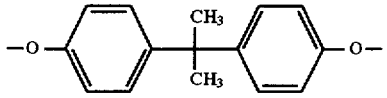
wherein $R^{11}$ each independently represents H, alkyl or fluoroalkyl.
* * * * *